US006227898B1

(12) United States Patent
Meng et al.

(10) Patent No.: US 6,227,898 B1
(45) Date of Patent: May 8, 2001

(54) CARD EDGE CONNECTOR WITH REMOVABLE RAIL GUIDE

(75) Inventors: Ching-Chang Meng; Ming-Chung Ko, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/412,882

(22) Filed: Oct. 5, 1999

(30) Foreign Application Priority Data

Dec. 18, 1998 (TW) ..... 87221133

(51) Int. Cl.[7] ..... H01R 13/64
(52) U.S. Cl. ..... 439/377; 439/374
(58) Field of Search ..... 439/377, 374

(56) References Cited

U.S. PATENT DOCUMENTS 4,274,693 * 6/1981 Cobaugh et al. ..... 439/374
5,129,831 * 7/1992 Locati ..... 439/374

* cited by examiner

*Primary Examiner*—Neil Abrams
*Assistant Examiner*—Phuong K. T. Dinh
(74) *Attorney, Agent, or Firm*—Wei Te Chung

(57) ABSTRACT

A card edge connector for connecting a daughter board to a mother board comprises an insulative housing, a number of contacts received in the housing, first rail guide disposed in the housing and extending beyond a top surface thereof, and second rail guide formed on opposite ends of the housing. The first rail guide includes at least one pair of retention posts. The two retention posts of the at least one pair are symmetrically disposed in the housing. The second rail guide includes two opposite retention members 42. Both the first and second rail guides are removable from the housing and adjustable in size and material to accommodate different daughter boards. A daughter board inserted into the housing is properly retained by the first and second rail guide in lateral and distal directions thereby preventing deformation of a middle portion of the daughter board.

12 Claims, 5 Drawing Sheets

CARD EDGE CONNECTOR WITH REMOVABLE RAIL GUIDE

BACKGROUND OF THE INVENTION

The present invention relates to a card edge connector for electrically connecting a daughter board to a mother board, and more particularly to a card edge connector having removable rail guide for guiding a daughter board into the connector during insertion.

DESCRIPTION OF PRIOR ART

Every computer device includes a main printed circuit board or a mother board. Additional printed circuit boards or daughter boards must be electrically connected to the mother board. A card edge connector is configured to receive a daughter board and provides electrical interconnection between the daughter board and the mother board to which the card edge connector is mounted. A typical card edge connector includes a dielectric housing having at least an elongate slot for receiving a daughter board and a plurality of passageways for receiving electrical contacts. The contacts include terminal portions downwardly extending from the housing and contact portions for engaging with conductive pads disposed along an edge of the daughter board inserted into the slot. The housing is mounted to a mother board with the terminal portions of the contacts being soldered to conductive areas of the mother board. The card edge connector receives the daughter board therein and the contacts provide conductive paths between the electrical pads of the daughter board and the conductive areas of the mother board. However, daughter boards may be dislocated from the card edge connector due to vibrations thereby causing intermittent or interrupted signal path connections between the daughter board and the mother board.

Taiwan Patent Application No. 84213255 discloses a conventional card edge connector without rail guide as shown in FIG. 1. In such a design, aligning a daughter board 5 with an elongate slot 6 of a connector 7 becomes difficult. After being inserted into the slot 6 of the connector 7, a middle portion of the daughter board 5 tends to deform because no rail guide is employed to support the daughter board 5.

FIG. 2 shows another conventional card edge connector, wherein rail guide 8 is separated from a housing 9 of a connector. The rail guide 8 has a large dimension and must be replaced when damaged thereby increases manufacturing costs. Additionally, since the rail guide 8 has an elongate shape, sophisticated manufacturing technology is required during molding to prevent deformation thereof.

A further conventional card edge connector is shown in FIG. 3. The connector comprises a dielectric housing 1', a plurality of contacts 3' arranged in two rows and a pair of guiding protrusions 11' integrally formed on opposite ends of the housing 1'. Each protrusion 11' comprises inner guiding surfaces 112' for guiding a daughter board 2' into an elongate slot 13' formed in the housing 1'. Since the guiding protrusions 11' are integral with the housing 1, daughter boards of different sizes cannot be accommodated. When a relatively high or thin daughter board is inserted into the slot 13' of the housing 1', the inserted daughter board tends to drift toward one row of the contacts 3' resulting in improper connection between the daughter board and the other row of the contacts 3'. The only way to solve such a problem is to provide different connectors to accommodate the corresponding daughter boards, which is inconvenient and increases manufacturing costs.

U.S. Pat. Nos. 5,026,292; 5,211,571; 5,242,312 and 5,449,297 also disclose related card edge connectors with the same problems as mentioned above.

Accordingly, there is a need for a card edge connector which accommodates daughter boards of different size and assists in retaining an inserted daughter board in position.

SUMMARY OF THE INVENTION

Accordingly, one object of the present invention is to provide a card edge connector having removable rail guide for accommodating daughter boards of different size.

Another object of the present invention is to provide a card edge connector having rail guide for preventing a middle portion of an inserted daughter board from deforming.

A further object of the present invention is to provide a card edge connector having rail guide made from resilient material for properly retaining a daughter board in position.

In order to achieve the objects set forth, a card edge connector in accordance with the present invention comprises an insulative housing, a plurality of contacts received in the housing, a first rail guide disposed in the housing and extending beyond a top surface thereof, and a second rail guide formed on opposite ends of the housing. The first rail guide includes two pairs of spaced retention posts. Each pair of retention posts is symmetrically arranged in the housing. The second rail guide includes two opposite retention members. Both the first and second rail guides are removable from the housing and adjustable in size and material to accommodate different daughter boards. A daughter board inserted into the housing is properly retained by the first and second rail guide in lateral and longitudinal directions thereby preventing deformation of a middle portion of the daughter board.

Other objects, advantages and novel features of the invention will become more apparent from the following detailed description when taken in conjunction with the accompanying drawings.

DETAILED DESCRIPTION OF THE INVENTION

Figure 1:
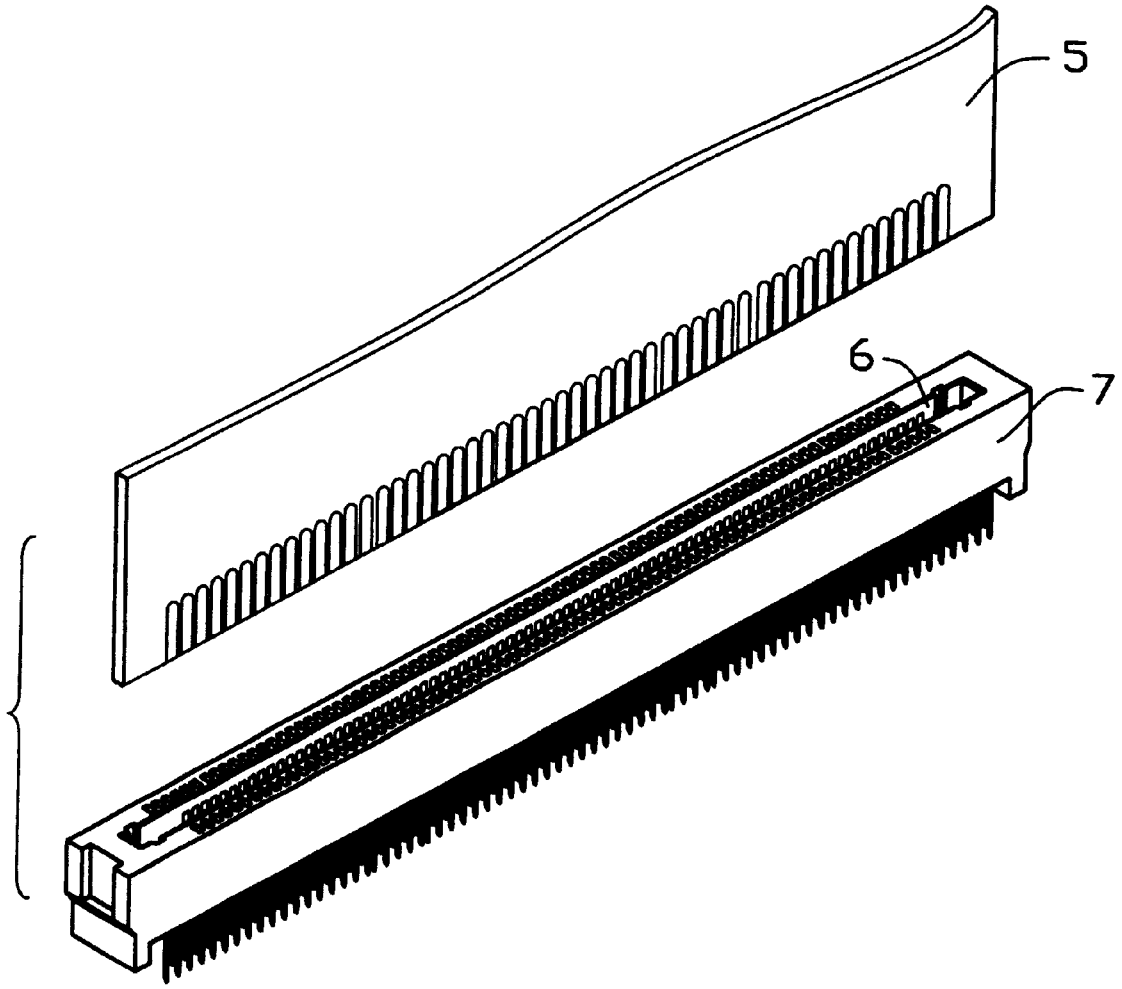
FIG. 1 (PRIOR ART)
FIG. 1 is a perspective view of a conventional card edge connector and a daughter board.
Figure 2:
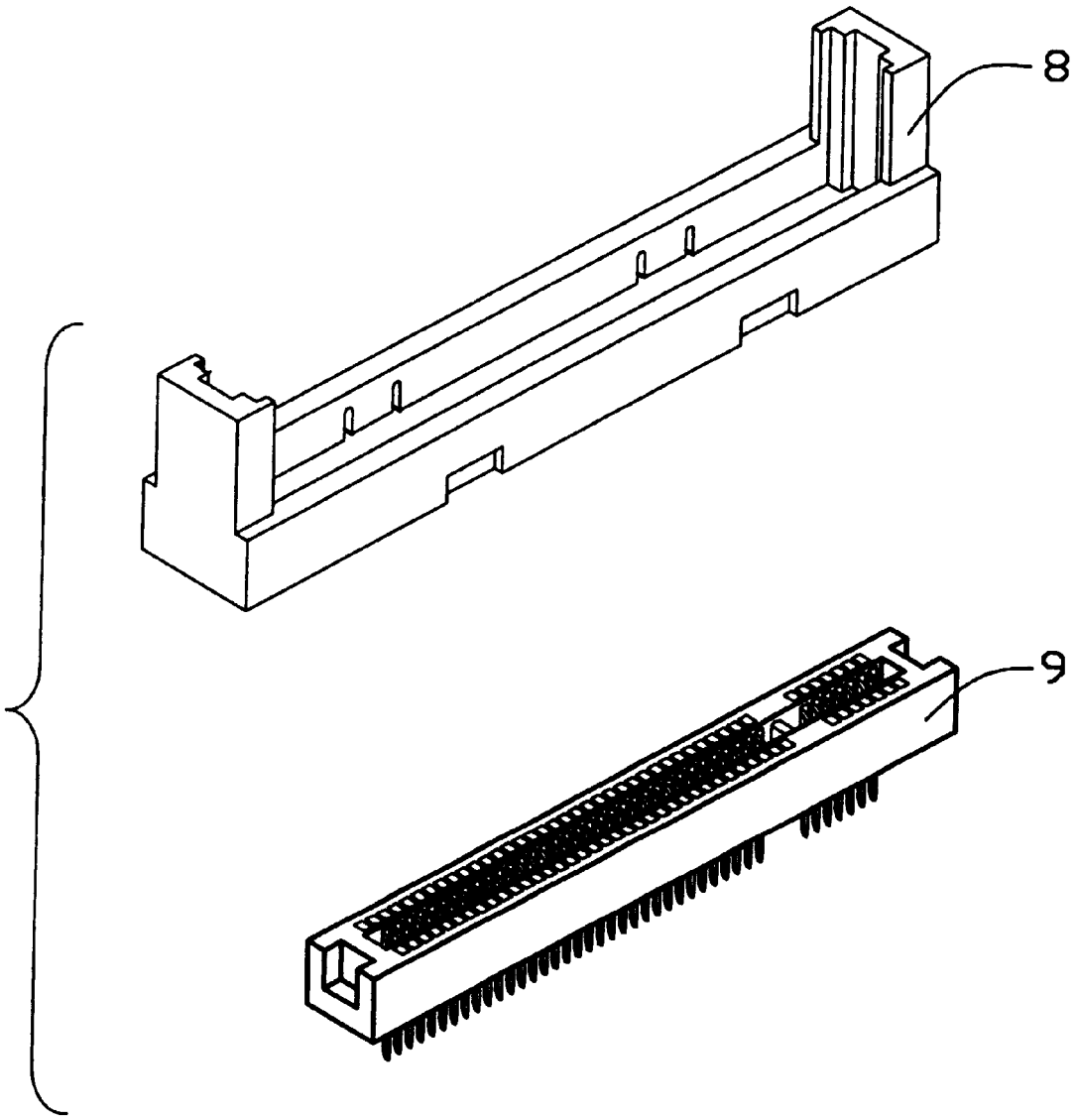
FIG. 2 (PRIOR ART)
FIG. 2 is a perspective view of another conventional card edge connector and rail guide.
Figure 3:
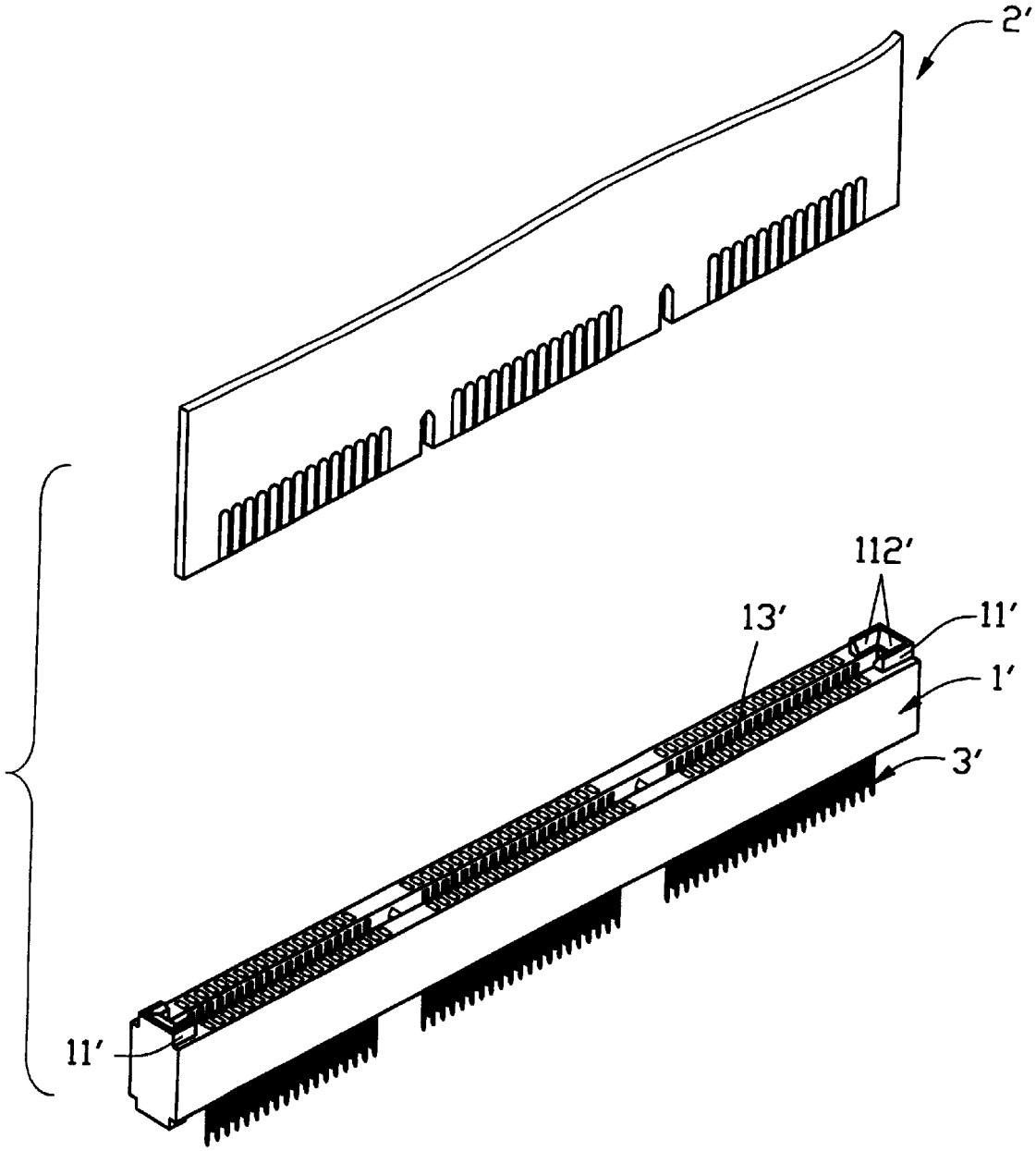
FIG. 3 (PRIOR ART)
FIG. 3 is a perspective view of a further conventional card edge connector and a daughter board.
Figure 4:
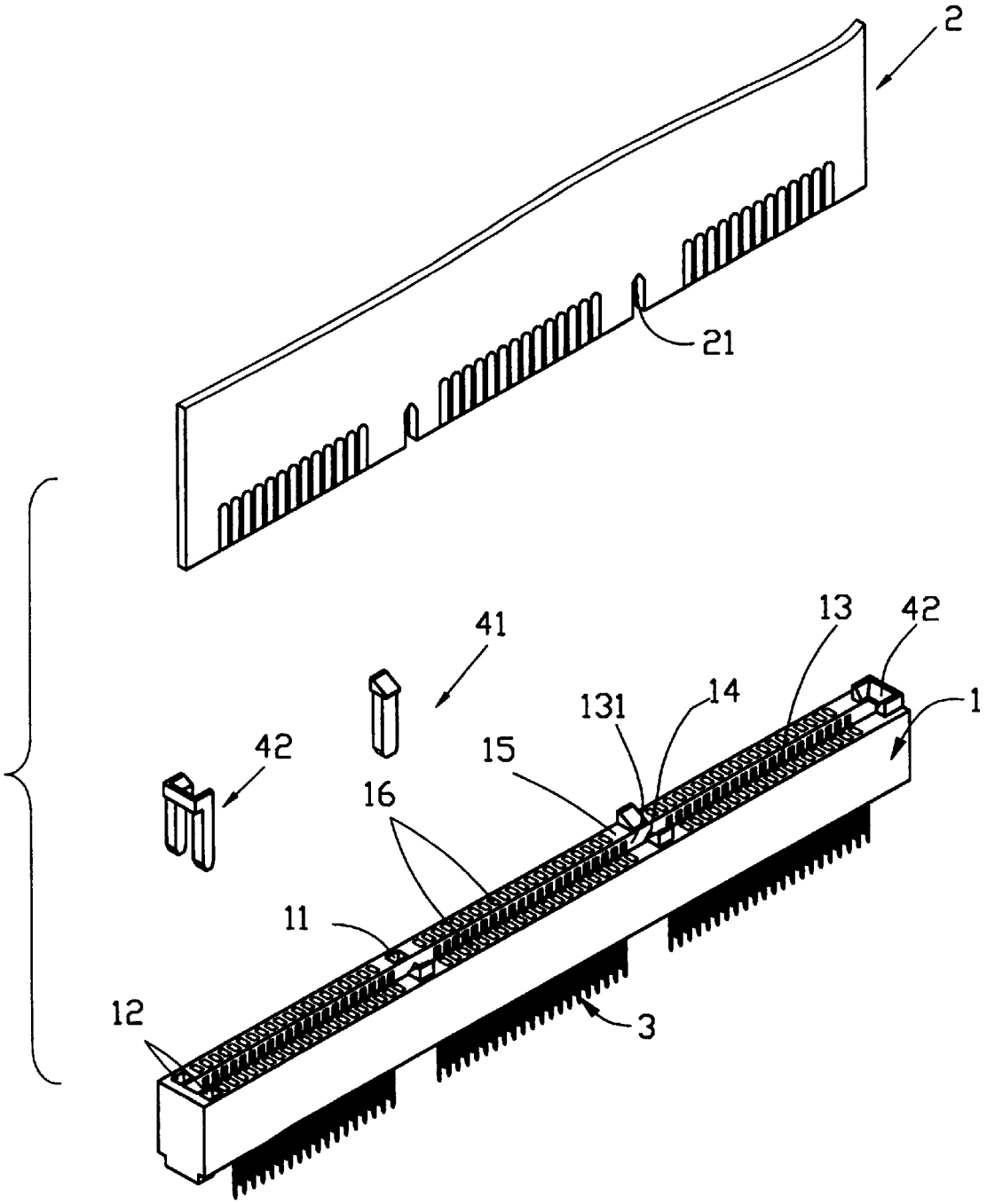
FIG. 4 is a perspective view of a card edge connector in accordance with the present invention and a daughter board to be inserted therein.

Referring to FIG. 4, a card edge connector in accordance with the present invention comprises an insulative housing 1, a plurality of contacts 3 received in the housing 1, a removable first rail guide located in the housing 1 and extending beyond a top surface thereof, and a removable second rail guide located proximate opposite ends of the housing 1. The first rail guide includes two pairs of spaced retention posts 41. The two retention posts 41 of each pair are symmetrically disposed in the housing 1. The second rail guide includes two opposite retention members 42.

The housing 1 is injection molded from dielectric material such as synthetic resin. An elongate slot 13 is formed in the housing 1 between two side portions 131 thereof for receiving an edge of a daughter board 2 therein and facilitating alignment of the daughter board 2 with the contacts 3. A plurality of contact receiving passageways 16 is defined through the side portions 131 for receiving the contacts 3 therein. The contacts 3 extend beyond a bottom surface of the housing 1 for engaging with corresponding conductive areas of a mother board (not shown) to which the connector is mounted. A pair of lugs 14 is disposed in the slot 13 corresponding to a pair of notches 21 defined in the daughter board 2 for ensuring proper orientation of the daughter board 2. A pair of spaced first engaging apertures 11 is disposed in a top surface 15 of each side portion 131 for insertion of the retention posts 41. An engaging area for engaging with the retention members 42 is in the form of a pair of opposite second engaging apertures 12 disposed proximate each distal end of the housing 1.

Figure 5:
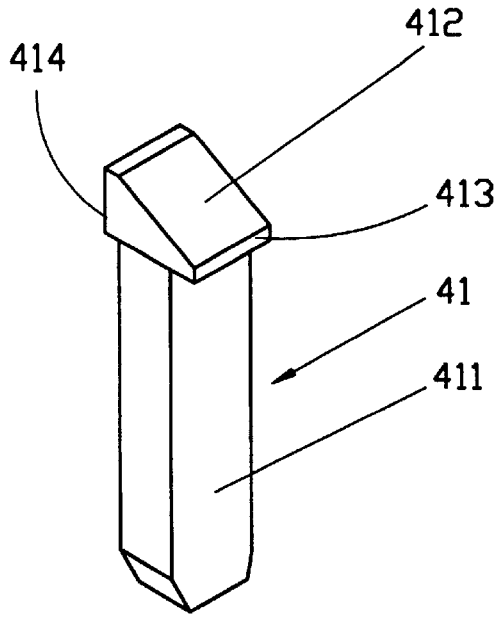
FIG. 5 is a perspective view of a retention post of the present invention.

Also referring to FIG. 5, the retention post 41 of the first rail guide comprises an engaging pole 411 and an integral cap 414. The engaging pole 411 is dimensioned to fittingly engage with the corresponding first engaging aperture 11. The cap 414 has a trapezoidal shape with a bottom surface area larger than a cross sectional area of the engaging pole 411 for abutting against the top surface 15 of the housing 1 after the engaging pole 411 is received in the first engaging aperture 11. The cap 414 further comprises an inclined guiding surface 412 for guiding the daughter board 2 into the slot 13 of the housing 1, and a retention surface 413 formed between the bottom surface of the cap 414 and the guiding surface 412 for retaining the inserted daughter board 2 in position. Both the guiding surface 412 and the retention surface 413 face a corresponding retention post 41 symmetrically disposed in the other side portion 131 of the housing 1.

Figure 6:
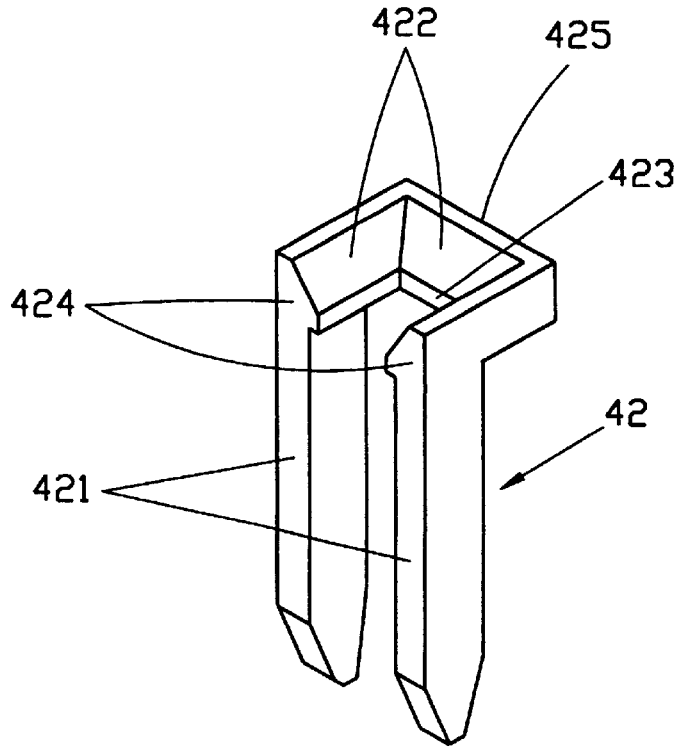
FIG. 6 is a perspective view of a retention member of the present invention.

Also referring to FIG. 6, the retention member 42 of the second rail guide has a shape which resembles two connected retention posts 41 of the first rail guide. The retention member 42 comprises a U-shaped header portion (not labeled) and a pair of mounting poles 421 integrally extending from the header portion. The U-shaped header portion consists of a pair of opposite cap sections 424 and a joint beam 425 interconnecting the two cap sections 424. Although not disclosed in the embodiments, it should be noted that one mounting pole 421 rather than two mounting poles can also be formed integrally extending from the join beam 425. Both the cap section 424 and the joint beam 425 comprise a guiding surface 422 and a retention surface 423 similar to those of the retention post 41 of the first rail guide. The guiding surfaces 412, 422 of the respective retention post 41 and the retention member 42 guide the daughter board 2 into the slot 13 of the housing 1. The retention surfaces 413, 423 of the respective retention post 41 and the retention member 42 properly retain the daughter board 2 in the slot 13 of the housing 1.

An insulative housing of an electrical connector is commonly made from rigid material having a high melting point, such as PPS as known in the art. Thus, conventional rail guide integrally formed with the housing of the connector exhibits poor resiliency thereby adversely affecting the ability thereof to retain an inserted daughter board in position. Since the first and second rail guides of the present invention are formed separately from the housing 1, they can be made from different material. Furthermore, the first and second rail guide can be formed to accommodate daughter boards of different sizes. The daughter board 2 is guided to accurately engage with the slot 13 of the housing 1 by the guiding surfaces 412, 422 of the respective retention posts 41 and the retention members 42 for connecting with a mother board. Resilient material, such as nylon, also can be applied to the first and second rail guide for resiliently retaining the daughter board 2 in position to ensure proper signal transmission.

Furthermore, since the retention posts 41 are located in the housing 1 and the retention members 42 are located proximate opposite ends of the housing 1, the daughter board 2 can be properly retained in the slot 13 of the housing 1 in both lateral and longitudinal directions thereby preventing deformation of a middle portion of the inserted daughter board 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for connecting a daughter board to a mother board, comprising:

an insulative housing having top and bottom surfaces, an elongate slot defined in the top surface for insertion of the daughter board, two rows of passageways respectively defined in opposite side portions of the slot, and a first pair of first engaging apertures defined in the top surface thereof, each first engaging aperture being in alignment with a corresponding row of passageways in an elongate direction of the insulative housing;

a plurality of contacts received in corresponding passageways of the housing; and removable rail guide assembled to the housing including a first pair of retention posts, each retention post comprising an engaging pole and an integral cap, the engaging pole being dimensioned for fittingly being received in a corresponding first engaging aperture of the housing, whereby the retention post is substantially embedded in the insulative housing with only the integral cap being upwardly exposed.

2. The card edge connector as described in claim 1, wherein the removable rail guide further comprises a second pair of retention posts, each individual retention post being symmetrically disposed with respect to its associated post.

3. The card edge connector as described in claim 2, wherein the insulative housing further comprises a second pair of first engaging apertures, each first engaging aperture of said second pair of first engaging apertures being symmetrically defined in the top surface of the housing with respect to its associated first engaging aperture for receiving a corresponding retention post.

4. The card edge connector as described in claim 1, wherein the cap of each retention post has a trapezoidal shape, a bottom surface area of the cap being larger than a cross-sectional area of the engaging pole.

5. The card edge connector as described in claim 4, wherein the cap of each retention post comprises a guiding surface and a retention surface between the bottom surface and the guiding surface, both the guiding and retention surfaces facing a corresponding symmetrically disposed retention post.

6. The card edge connector as described in claim 1, wherein the rail guide is made from resilient material.

7. A card edge connector for connecting a daughter board to a mother board, comprising:

an insulative housing having top and bottom surfaces, an elongate slot defined in the top surface for insertion of the daughter board, a plurality of contacts disposed by two sides of the slot, a plurality of engaging apertures defined circumferentially in the top surface of the housing; and removable rail guide assembled to the housing including a retention post comprising an engaging pole and an integral cap, the engaging pole being dimensioned for fittingly engaging with the corresponding engaging aperture of the housing while the cap protrudes above the top surface of the housing wherein said rail guide is located within a circumference of the housing.

8. The connector as described in claim 7, wherein said retention post is made of relatively elastic material different from that of the housing.

9. The card edge connector as described in claim 1, wherein the insulative housing further comprises an engaging area disposed proximate each opposite end thereof, and wherein the removable rail guide further comprises a pair of retention members for engaging with corresponding engaging areas.

10. The card edge connector as described in claim 9, wherein each retention member comprising a U-shaped header portion and at least one mounting pole integral with the header portion for fittingly engaging with corresponding engaging area of the housing, the header portion consisting of a pair of opposite cap sections and a joint beam interconnecting the two cap sections.

11. The card edge connector as described in claim 10, wherein the at least one mounting pole comprises a pair of mounting poles downwardly extending from respective cap sections.

12. The card edge connector as described in claim 11, wherein the engaging area is in the form of a pair of second engaging apertures for receiving corresponding mounting poles.

* * * * *